US009617763B2

(12) United States Patent
Graute et al.

(10) Patent No.: US 9,617,763 B2
(45) Date of Patent: Apr. 11, 2017

(54) LOCK FOR A VEHICLE DOOR WITH A SPRING PLATE IN THE INLET REGION OF THE LOCKING BOLT

(75) Inventors: Ludger Graute, Essen (DE); Omer Inan, Dorsten (DE); Ulrich Weichsel, Duisburg (DE)

(73) Assignee: Kiekert AG, Heiligenhaus (DE)

( * ) Notice: Subject to any disclaimer, the term of this patent is extended or adjusted under 35 U.S.C. 154(b) by 370 days.

(21) Appl. No.: 14/233,573

(22) PCT Filed: Jul. 10, 2012

(86) PCT No.: PCT/DE2012/000688

§ 371 (c)(1),
(2), (4) Date: Apr. 16, 2014

(87) PCT Pub. No.: WO2013/010526

PCT Pub. Date: Jan. 24, 2013

(65) Prior Publication Data

US 2014/0291999 A1 Oct. 2, 2014

(30) Foreign Application Priority Data

Jul. 18, 2011 (DE) ..... 10 2011 107 877

(51) Int. Cl.
*E05C 19/06* (2006.01)
*E05C 3/16* (2006.01)
(Continued)

(52) U.S. Cl.
CPC ..... *E05B 85/00* (2013.01); *E05B 15/04* (2013.01); *E05B 77/36* (2013.01); *E05B 77/38* (2013.01);
(Continued)

(58) Field of Classification Search
CPC .. E05B 15/0006; E05B 17/0045; E05B 15/04; E05B 77/36; E05B 77/38;
(Continued)

(56) References Cited

U.S. PATENT DOCUMENTS 1,931,695 A * 10/1933 Hall ..... E05C 19/063 16/85
2,511,998 A * 6/1950 Rummelsburg ..... E05C 19/063 292/17
(Continued)

FOREIGN PATENT DOCUMENTS

DE 19824466 A1 * 12/1999 ..... E05B 85/26
DE 10215691 A1 * 1/2003 ..... E05B 85/26
(Continued)

OTHER PUBLICATIONS

International Search Report for corresponding patent application No. PCT/DE2012/000688 dated Nov. 23, 2012.

*Primary Examiner* — Kristina Fulton
*Assistant Examiner* — Christine M Mills
(74) *Attorney, Agent, or Firm* — Renner, Otto, Boisselle & Sklar, LLP

(57) ABSTRACT

A lock is provided especially for a door (2) or flap of a motor vehicle. Said lock has a lock housing (3) and a locking mechanism having a rotary latch (4) and a pawl, wherein the rotary latch (4) is arranged pivotably about an axis (22) and interacts with a locking bow (9), which is assigned to the bodywork (8), during the opening and closing of the door (2). At least one spring plate (15) which is oriented substantially parallel to the rotary latch (4) and surrounds the locking bow (9) in the locking position of the lock is arranged in the lock inlet region of the lock housing (3).

13 Claims, 5 Drawing Sheets

Figure 1:
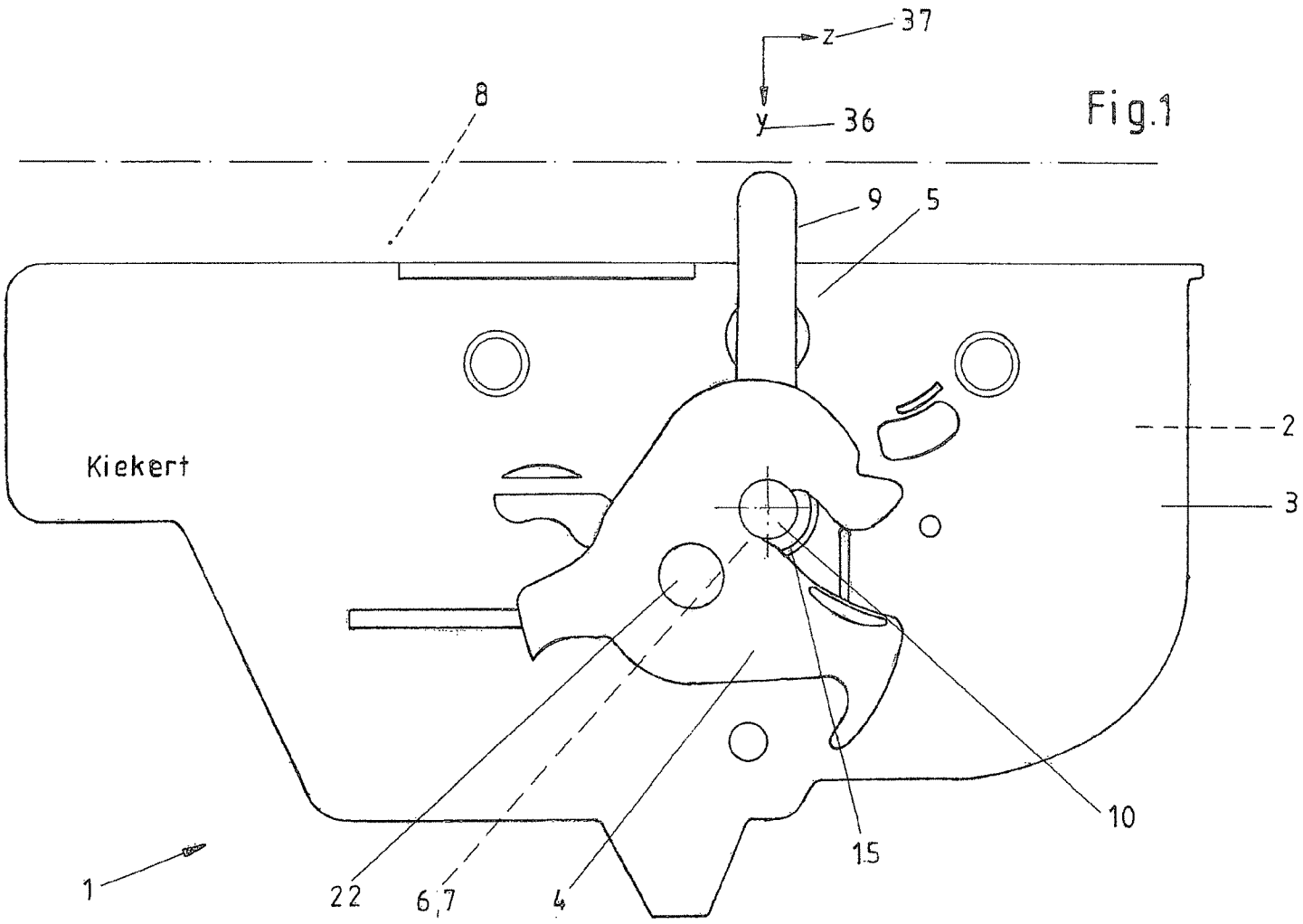

(51) Int. Cl.

| | |
|---|---|
| ***E05B 85/00*** | (2014.01) |
| ***E05B 77/42*** | (2014.01) |
| ***E05B 77/36*** | (2014.01) |
| ***E05B 15/04*** | (2006.01) |
| ***E05B 85/02*** | (2014.01) |
| ***E05B 85/24*** | (2014.01) |
| ***E05B 77/38*** | (2014.01) |
| *E05B 77/34* | (2014.01) |

(52) U.S. Cl.
CPC ..... *E05B 77/42* (2013.01); *E05B 85/02* (2013.01); *E05B 85/243* (2013.01); *E05B 77/34* (2013.01); *Y10S 292/23* (2013.01); *Y10S 292/56* (2013.01); *Y10S 292/73* (2013.01); *Y10T 292/0894* (2015.04); *Y10T 292/1047* (2015.04)

(58) Field of Classification Search
CPC ..... E05B 77/42; E05B 85/00; E05B 85/02; E05B 85/243; E05B 85/26; E05B 2015/0458; Y10S 292/56; Y10S 292/57; Y10S 292/73; Y10S 292/23; Y10T 292/0945; Y10T 292/0894; Y10T 292/1047
USPC ..... 292/194, 216, DIG. 23, 340, 341.11, 292/341.12, DIG. 56, DIG. 57, DIG. 73, 292/80, 96
See application file for complete search history.

(56) References Cited

U.S. PATENT DOCUMENTS

| | | | | | |
|---|---|---|---|---|---|
| 2,942,905 | A * | 6/1960 | Wootton | E05C 19/063 | 248/222.12 |
| 3,261,628 | A * | 7/1966 | Kesling | E05C 19/063 | 292/17 |
| 3,520,568 | A * | 7/1970 | White | D06F 37/28 | 292/255 |
| 4,941,696 | A | 7/1990 | Yamada et al. | | |
| 5,606,771 | A * | 3/1997 | Young | B60J 5/06 | 16/82 |
| 5,727,825 | A * | 3/1998 | Spurr | E05B 85/26 | 292/341.12 |
| 5,918,918 | A * | 7/1999 | Mosley | E05B 77/38 | 292/341.12 |
| 5,979,592 | A * | 11/1999 | Delgado | E05C 17/045 | 181/200 |
| 7,686,353 | B2 * | 3/2010 | Lewis | E05B 17/0004 | 16/82 |
| 8,104,848 | B2 * | 1/2012 | Yoon | D06F 37/42 | 292/10 |
| 2006/0087126 | A1 * | 4/2006 | Roussel | E05B 77/38 | 292/116 |
| 2007/0241570 | A1 * | 10/2007 | Paskonis | E05B 85/045 | 292/340 |

FOREIGN PATENT DOCUMENTS

| | | | | | |
|---|---|---|---|---|---|
| DE | 10160096 | C1 * | 4/2003 | B60J 7/1851 | |
| DE | 202006018744 | U1 | 2/2007 | | |
| DE | WO 2007073723 | A1 * | 7/2007 | E05B 85/26 | |
| DE | EP 2251509 | A2 * | 11/2010 | E05B 83/16 | |
| DE | 102010005843 | A1 * | 7/2011 | E05B 77/00 | |
| DE | 102010012896 | A1 * | 9/2011 | E05B 85/02 | |
| EP | 0 978 606 | A2 | 2/2000 | | |
| EP | 2 251 509 | A2 | 11/2010 | | |
| FR | 2 498 238 | A1 | 7/1982 | | |
| FR | 2539793 | A1 * | 7/1984 | E05B 77/38 | |
| FR | 2969682 | A1 * | 6/2012 | B60R 21/34 | |
| GB | 2 282 843 | A | 4/1995 | | |
| JP | 1 239279 | A | 9/1989 | | |
| WO | WO 2007/073723 | A1 | 7/2007 | | |

* cited by examiner

LOCK FOR A VEHICLE DOOR WITH A SPRING PLATE IN THE INLET REGION OF THE LOCKING BOLT

The invention relates to a lock for a door or flap of a motor vehicle or building having a lock housing and a locking mechanism containing a rotary latch and a pawl in which the rotary latch is pivotably arranged around an axis and interacts with a locking bow assigned to the bodywork during opening and closing of the door.

Motor vehicle door locks as well as locks with a locking bow and rotary latch are generally known in which the locking bow often consists of formed wires fixed to a base plate. For automotive motor vehicle door locks, generally a locking mechanism consisting of a rotary latch and pawl are used in order to secure the locking bow attached to the bodywork or the door fixed thereto. The motor vehicle door lock is usually secured to a motor vehicle door or a tailgate. In the closed state of such a lock the load arm of the rotary latch often grips around the locking bolt of the locking bow. During this process, the rotary latch pulls the locking bolt into the motor vehicle door lock even against the force of the door seal and is then itself blocked by the pawl in such a way that unintentional opening is prevented. During driving of the motor vehicle, movements are, however, generated between the rotary latch and the locking bolt. In particular, it is possible that relative movements between the rotary latch and locking bolt generate compression stresses and/or frictional forces so that, in particular, in case of an ingress of dust grains creaking or respective noises can be generated. For the safe operation of a lock and for reducing said noises, DE 20 2006 018 744 U1 discloses a damping element or a damper that, when the door or flap is closed, is arranged directly next to the rotary latch and is flexible to cushion the locking bolt inserted through the lock inlet region. This damping element contains a guide section, forming at least one section of the mounting in the direction of the opening area of the lock inlet region. WO 2007/073723 A1 discloses a motor vehicle door lock containing a locking mechanism comprising a rotary latch and a pawl as well as a damping element. Together with the associated locking mechanism stops the, in this case, round damping element restricts an opening and a closing movement of the rotary latch. This damping element is made of an elastomeric plastic.

The invention has the task of reducing noise generated between the rotary latch and locking bolt as far as possible and of avoiding, in particular, a so-called creaking in the area in which the lock is connected to the bodywork.

The invention solves the task, by a spring plate being arranged in the lock inlet region of the lock housing with such arrangement being at least substantially parallel to the rotary latch, which encloses the locking bow in the locked position of the lock.

In addition to the damping elements provided in the prior art, this spring plate absorbs possible movements of the respective door or flap, perpendicularly to the driving direction of a motor vehicle, and thus in case of a motor vehicle side door such movements or vibrations occurring around the respective hinge points of the door. The spring plate used in the invention does not have the high temperature dependency of the usually used buffers made from rubber or plastic. Possibly also the usual use of the aforementioned damper arranged next to the rotary latch, as disclosed in DE 20 2006 018 744 U1 and possibly also the inlet lip disclosed in this document is no longer necessary. The tooling costs for the production of the entire lock housing are lower and more options are available when selecting the material, in particular, as the usual spring lip is no longer required. A further advantage is that, as no additional openings are required in the lock housing, e.g. for the rubber buffer, the required water management is lower.

According to a further advantageous embodiment of the invention, the spring plate is designed as a spring clip made of spring steel. Such a spring clip can be designed in such a way that unavoidable movements of the motor vehicle door during driving can be dampened. The used spring plate consequently restricts the movement of the lock housing and thus of the door in Z direction, i.e. the direction perpendicular to the driving direction of the vehicle in such a way that the door is steadied further. Said additional or creaking noises are thus reduced or eliminated completely.

In a further advantageous embodiment the locking bow contains a locking bolt, a supporting bolt and a cross bolt arranged there between, with the rotary latch enclosing the locking bolt during opening and closing of the lock and the spring plate enclosing the cross bolt in the closed position of the lock. During locking of the door, the locking bolt is inserted in the spring clip which then encloses the top end section of the locking bolt and, in particular, the cross bolt grasping said cross bolt securely to ensure that the door is stationary. As the spring plate encloses the locking bow in the region of the cross bolt and the rotary latch encloses the locking bow in the region of the locking bolt, both components have a dampening effect on the locking bow at a distance to each other and in other directions, which is advantageous.

In an appropriate embodiment of the spring plate, the spring plate contains two spring arms extending from a round arch and whose free ends bend away from the cross bow for fixing in the lock housing. In this way the spring plate specifically acts on the cross bolt of the locking bow with the pressing forces being increased in the region of the bent sections, so that any noises caused by movements of the door or flap during driving, are dampened accordingly. After reaching the closed position of the lock, the cross bolt is arranged between the two spring arms so that the pressing forces are advantageously applied in Z direction, i.e. perpendicular to the driving direction of the vehicle.

In a further embodiment, the spring arms contain bent sections providing a favourable form or design for the spring arms to linearly abut and rest against the cross bolt in an advantageous manner. This allows the two spring arms to precisely act on the optimum area of the cross bolt in order to fixate it and to become active with the rotary latch so that the noise of the door or flap is attenuated, as desired.

In order to provide a simple assembly of the overall lock housing and, in particular, of the spring plate, the invention provides for the lock housing to contain assemblies housing the spring plate with the round arch and the spring arms. Consequently no holes or outlets are provided in the lock housing, which, as already mentioned, simplifies water management. Also, the spring plate or spring clip can be simply inserted in the lock housing to immediately assume the correct position without additional welding work or similar.

This inserting is, in particular, facilitated by the fact that the assemblies are arch-shaped, taking into consideration the pre-stressing, thus allowing the spring plate to be pushed in or inserted. Due to the spring effect of the spring plate no separate fixing is required in the assemblies but instead, the entire spring clip reliably fits into the arrangement of the lock housing.

The fact that the assemblies are designed and arranged to restrict the movements of the free ends of the spring arms prevents overloading of the spring arms or an unintentional deformation. This means that, in particular, the free ends of the spring arms are not only fixed in the assemblies as a result of the spring force but can also only carry out limited movements towards or away from the cross bolt as a result of the assemblies.

The spring effect of the spring plate can, apart from the material selection, also be set by the spring plate being preferably designed to have a width equal to the diameter of the cross bolt over its entire length or containing a round arch with a reduction step.

The invention is characterized in particular by the fact that the provided spring plate is a component which without considerable additional manufacturing and setup work ensures that most or all noise during the use of the vehicle is eliminated. The door is kept steady by the rotary latch and, in particular, also by the spring plate. Even if dust or sand should enter the lock housing, the selected design, in particular of the lock, prevents any creaking noise. It is also advantageous that the lock housing does not have to be drilled or influenced in any other way for the assembly of the spring plate but that instead the spring plate is simply inserted in the assemblies or attachments of the lock housing.

Figure 2:
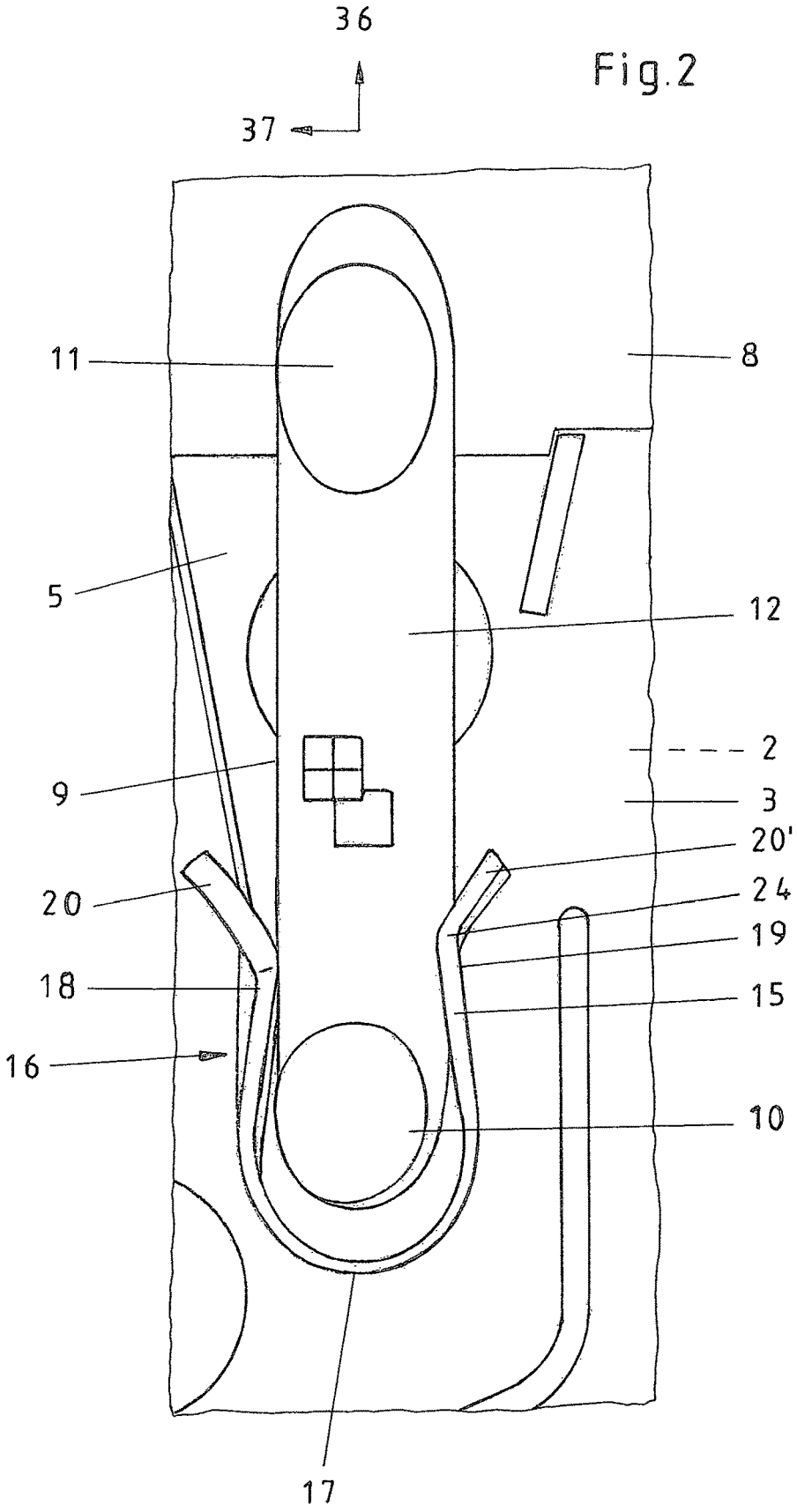
Figure 3:
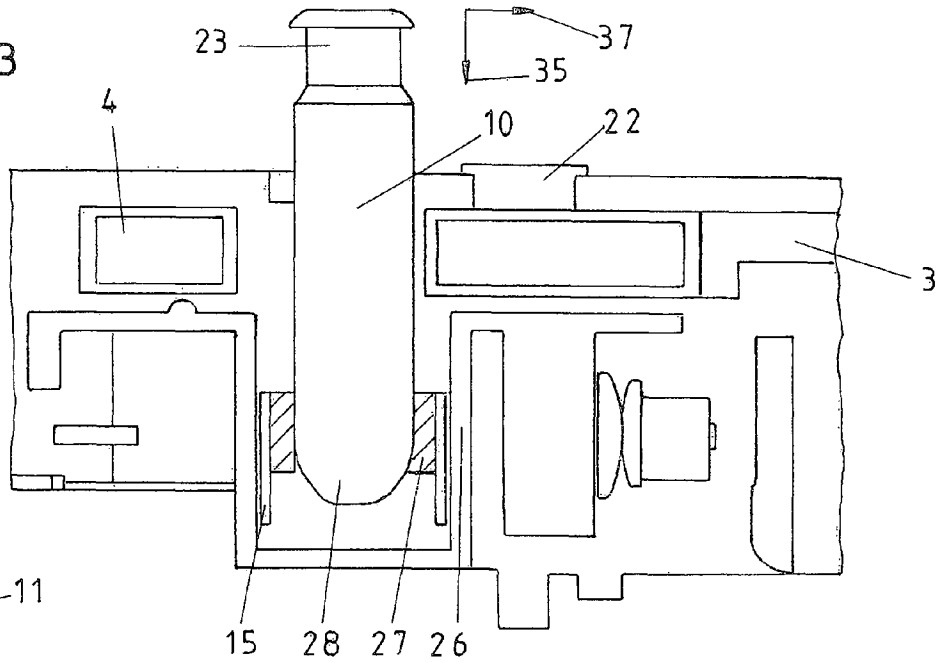
Figure 4:
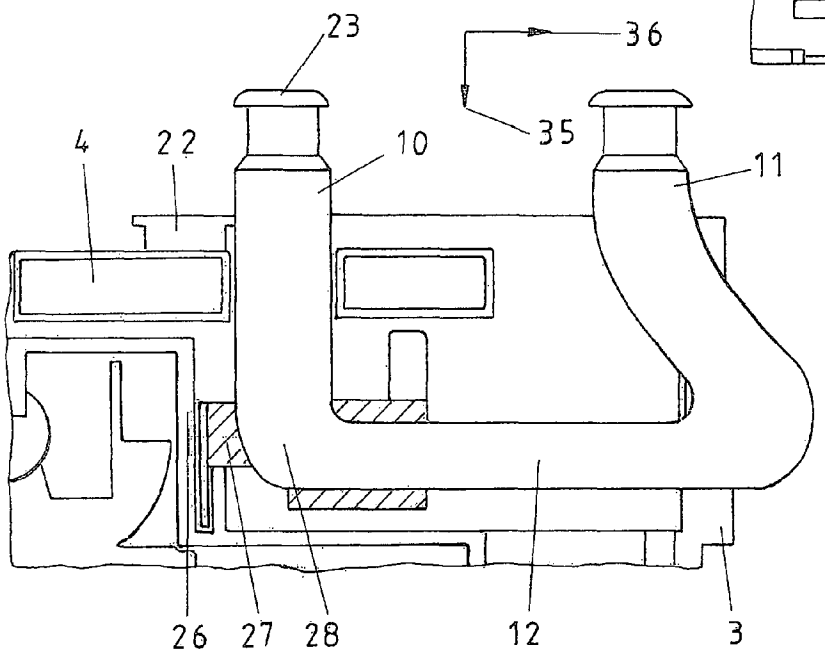
Figure 5:
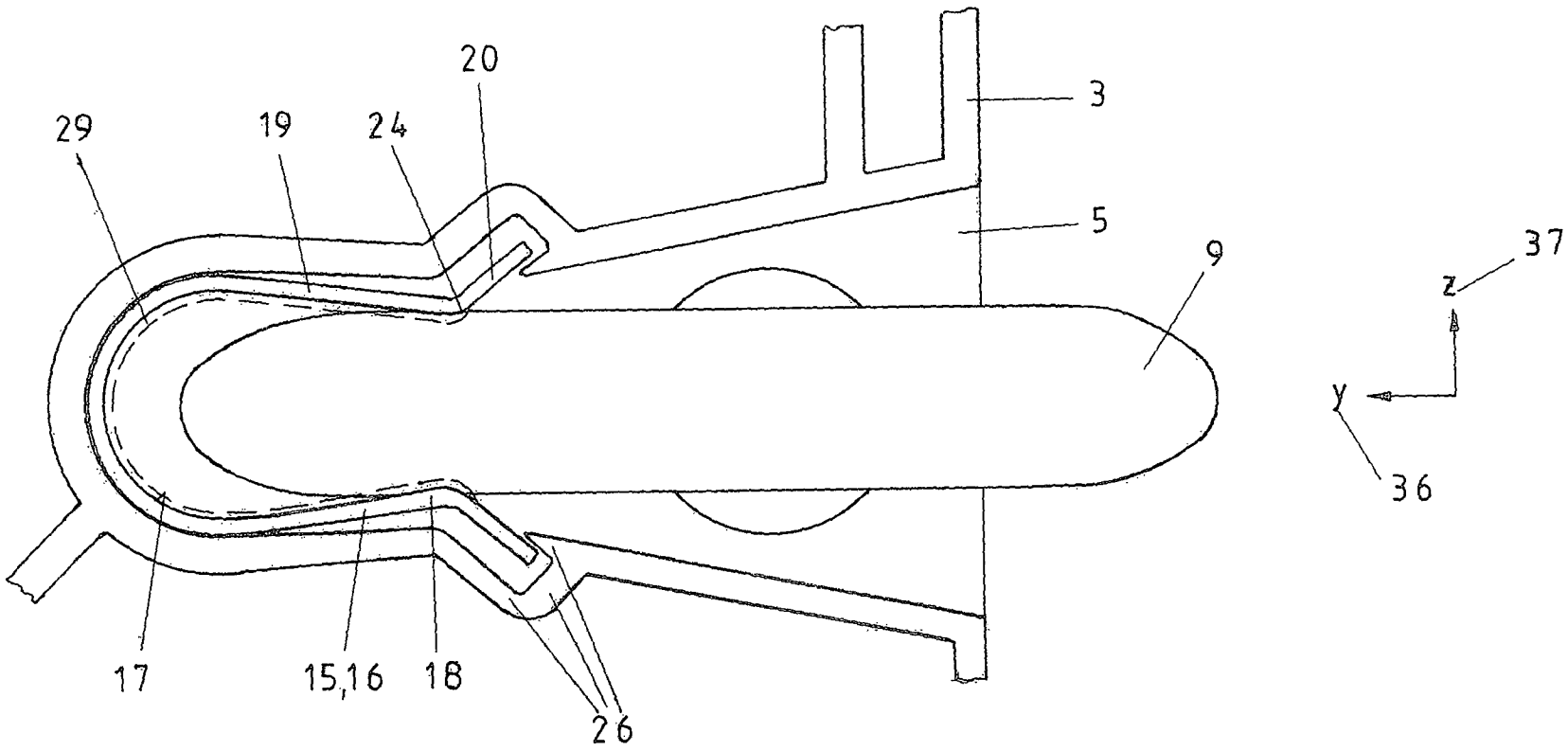
Figure 6:
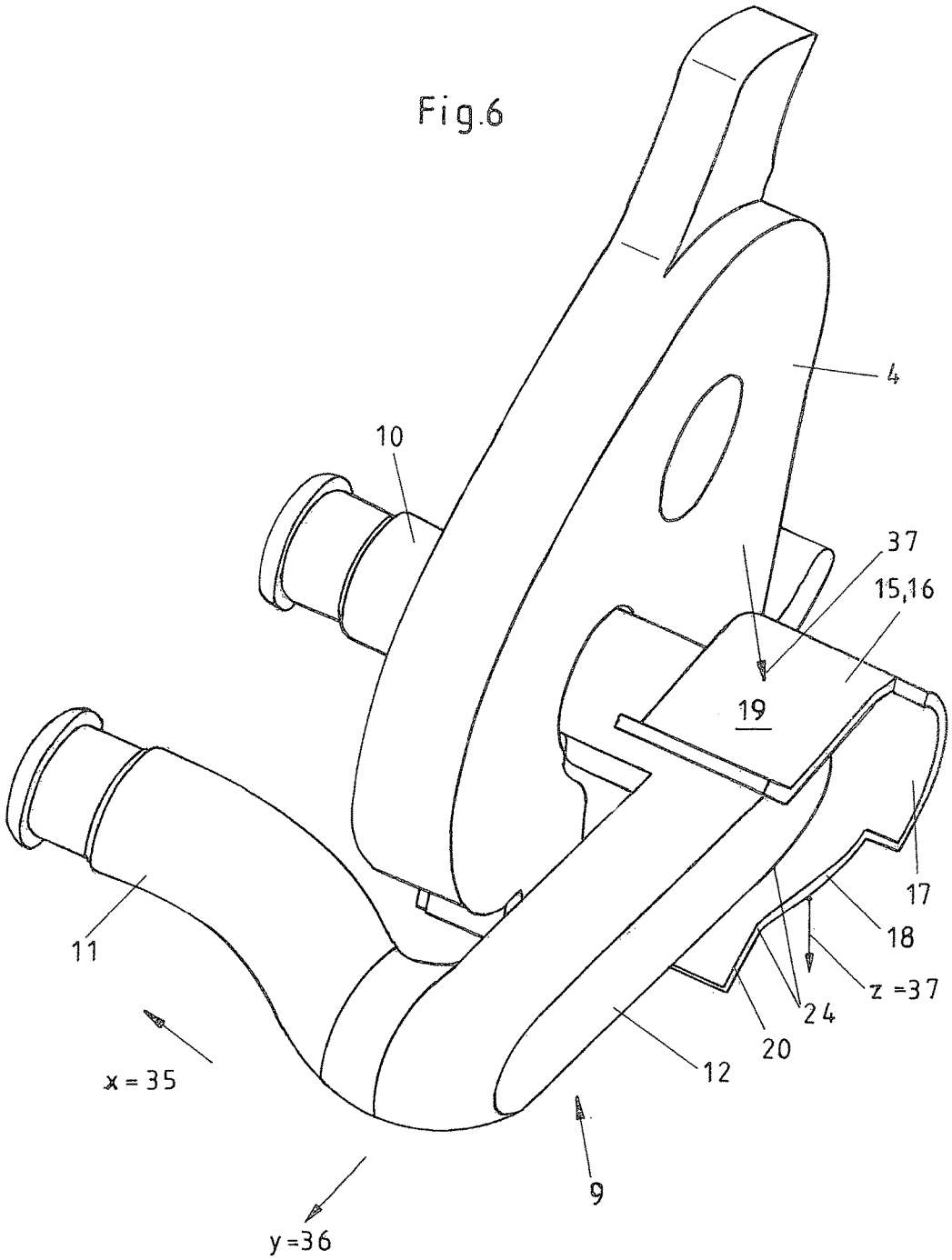

Further details and advantages of the object of the invention are detailed in the below descriptions to the related drawing, showing a preferred embodiment with the required details and individual parts, in which:

FIG. 1 shows a view from the top onto the lock housing with the rotary latch in the closed state of the lock, FIG. 2 shows a view from the top onto the lock housing, without rotary latch FIG. 3 shows a longitudinal section through the lock housing with the locking bolt and spring plate FIG. 4 shows a cross section through the lock housing with the locking bolt and spring plate FIG. 5 shows a view from the top onto the lock inlet region with the used spring plate and FIG. 6 shows a perspective view and clarifications of the positions of the rotary latch and spring plate in relation to the locking bow.

FIG. 1 shows part of a lock 1 intended for motor vehicle with the lock housing 3 assigned to the door 2 and the locking bow 9, assigned to the bodywork 8. The lock housing 3 contains the rotary latch 4 and also further associated components of the closing and securing mechanism—not shown—such as the pawl. The rotary latch 4 is shown in the closed condition of the lock 1, with the rotary latch 4 having pivoted or turned around the locking bow 9 inserted through the lock inlet region 5 or its locking bolt 10. The drawing shows the spring plate 15, which in this case has a certain distance to the locking bolt 10, as well as the axis of rotation 22, around which the rotary latch 4 is rotated. Due to the special form of the rotary latch 4, the door 2 moves towards the bodywork 8 during closing so that the door 2 is closed. The door is even closed despite of the force of the door seals—not shown. When closing the door 2, the rotary latch 4 closely abuts the locking bolt 10 of the locking bow 9, as shown in FIG. 1. This movement of the door 2 is in Y direction, i.e. nearly horizontal to the driving direction in the direction of the motor vehicle seats.

In FIG. 2, the rotary latch 4 is not installed and thus not shown. As a result, the shape or position of the locking bow 9 is clearly apparent. Numeral 10 refers to the locking bolt and 11 to the opposing supporting bolt, connected by means of the cross bolt 12.

The spring plate 15 is designed as a clip 16 or a spring clip, in which the round bow 17 provides the required pressing force against the cross bolt 12. Two spring arms 18, 19 are connected to this round bow 17, with the free ends 20, 20' of the arms being slightly bent or edged. As indicated in FIG. 2, the two spring arms 18, 19 abut precisely in the region of the bent section 24 against the locking bow 9 or, in particular, the locking bow 12. Further information is provided below.

FIG. 3 shows a longitudinal section through the lock housing 3 and, it is apparent that the foot of the bolt 23 of the locking bolt 10 has a shape facilitating secure anchoring in the base plate—not shown. The locking bolt 10 itself is in some ways inserted in the lock housing 3 and is enclosed by the spring plate 15—shown here in dashed lines—in the region of the cross bolt 12. Apart from the locking bow 9 or locking bolt 10, the Figure also shows rotary latch 4 with its axis 22. Because of the chosen sectional view, the inner sides of the rotary latch 4 are shown at a certain distance to the locking bolt 10.

The spring plate 15 is inserted in provided assemblies 26 into the lock housing 3, with the special shape of the spring plate 15 being emphasized again, in particular, in FIG. 5. Apart from the Z direction 37 also the driving direction 35, i.e. the X direction is shown, which also shows that the insertion of the locking bow 9 into the lock housing 3 or the lock inlet region 5 is perpendicular to the driving direction but horizontal.

In contrast to FIG. 3, FIG. 4 shows a cross section from which it is apparent that of the entire locking bow 9 it is actually only the locking bolt 10 and again the cross bolt 12 that are affected by the spring plate 15 to ensure the best possible fixing of the locking bolt 10 in the rotary latch 4 and in the spring plate 15. The Figure shows that in the area of the foot of the bolt 23, the rotary latch 4 comprises the locking bolt 10, whilst the zone of influence of the spring plate 15 is located at a distance thereof inside the lock housing 3 in the area of the cross bolt 12 and of the top end of the locking bolt 10. FIG. 4 also shows that the spring plate 15 contains a so-called reduction step 27, i.e. the width of the spring plate 15 in the area of the cross bolt 12 and thus the spring arms 18, 19 is greater than in the area of the round bow 17 or of the locking bolt 10. The respective greater width in the area of the cross bolt 12 allows, in particular, effective pressing against the cross bolt 12 and thus the locking bow 9, whilst the spring plate 15 is respectively narrower in the round bow 17. This can also be used to influence the force of the spring by selecting the respective suitable reduction step 27. FIG. 4 also shows that, using assemblies 26, the spring plate 15 can be arranged securely in the lock housing 3. Advantageously, the preformed component spring plate 15 can be simply inserted from the top into the recesses or assemblies 26. Numeral 35 indicates the driving direction or X direction and numeral 36 the Y direction, i.e. the horizontal direction to the driving direction in which the locking bow 9 is moved into the zone of influence of the lock housing 3 and in which the seats are located.

The lock inlet region 5 is clearly apparent from FIG. 5, with this lock inlet region 5 being funnel shaped. It is also apparent that the free ends 20, 20' of the spring arms 18, 19 are seated in the assemblies 26 of the lock housing 3. Furthermore it is apparent that the round bow 17 connects to the spring arms 18, 19, connecting both spring arms 18, 19 to each other. It is also apparent that the spring arms 18, 19 rest closely and linearly against the cross bolt 12 and thus the locking bow 9 in particular in the region of the bent area 24, thus always producing the desired additional fixing to the rotary latch 4. This Figure also shows that the range of movement of the spring arms 18, 19 or of its free ends 20, 20' is restricted by the respectively formed assemblies 26 so that overloading of the spring plate 15 is not possible. FIG. 5 also shows that the entire spring plate 15 can be inserted into the respective assemblies 26 from the top. Where required, elastic plastic material 29 may be applied to the inside of the spring plate 15, in order to be able to simply absorb or buffer any shocks caused by the insertion of the locking bolt 10 into the lock housing 3. In this figure, too, the Z direction 37, transversely to the driving direction and the Y direction 36 are indicated.

FIG. 6 shows a perspective view of the important parts of the lock 1 and the relationship of these components to each other. The figure shows the locking bow 9 with the locking bolt 10 and the supporting bolt 11 as well as the cross bolt 12 connecting the two bolts. Whilst the rotary latch 4 is pivoted or turned around the locking bolt 10 when closing the lock 1 in order to move the door 2 in the direction of the bodywork 8, the spring plate 15 in form of the clip 16, is pushed onto the locking bow 9 in direction 36, i.e. Y direction and, in particular onto its cross bolt 12, thus also enclosing the locking bolt 10. Using the spring arms 18, 19, the spring plate 15 now presses in the shown position and, in particular, in the region of the bent section 24 onto the cross bolt 12 in Z direction 37, so that the cross bolt 12 is enclosed and the door 2 can be advantageously additionally secured. Numeral 35 indicates the X direction, i.e. the driving direction, whilst Y or 36 represents the insertion direction in which the spring plate 15 is pushed onto the cross bolt 12.

All described characteristics, including those only shown in the Figures, are on their own or in combination part of the invention.

The invention claimed is:

1. A lock for a door, wherein the lock and the door are moveable in a driving direction, the lock comprising a locking mechanism and the locking mechanism comprising:

a lock housing having a lock inlet region;

a rotary latch arranged in the lock housing and pivotable about an axis between an unlocked position and a locked position, wherein the rotary latch is oriented perpendicular to the driving direction;

a locking bow having a first end and a second end opposite the first end, the locking bow having a locking bolt extending from the first end of the locking bow through the rotary latch, a supporting bolt extending from the second end of the locking bow and parallel to the locking bolt, and a cross bolt arranged perpendicular to the locking bolt and the supporting bolt for connecting the locking bolt and the supporting bolt, the cross bolt being spaced from the rotary latch and extending parallel with the rotary latch; and at least one spring plate that is spaced from the rotary latch, the at least one spring plate having spring arms that extend parallel with the rotary latch and along the cross bolt, wherein the spring arms contain bent sections that directly rest against the cross bolt, wherein the at least one spring plate encloses the first end of the locking bow and is arranged in the lock inlet region, wherein the at least one spring plate is configured to absorb movements of the door that are perpendicular to the driving direction of the lock and the door.

2. The lock according to claim 1, wherein the at least one spring plate is a spring clip made from spring steel.

3. The lock according to claim 1, wherein the rotary latch is mounted on the locking bolt.

4. The lock according to claim 1, wherein the spring arms extend from a round bow, wherein free ends of the spring arms are bent away from the cross bolt.

5. The lock according to claim 4, wherein the lock housing contains the at least one spring plate with the round bow.

6. The lock according to claim 5, wherein the lock housing contains recesses in which the free ends of the spring arms are seated for securing the at least one spring plate within the lock housing.

7. The lock according to claim 6, wherein the recesses are configured to allow the plugging in or insertion of the at least one spring plate.

8. The lock according to claim 6, wherein the recesses are arranged to prevent movement of the free ends of the spring arms.

9. The lock according to claim 1, wherein a width of the at least one spring plate corresponds to the diameter of the cross bolt along an entire length of the at least one spring plate.

10. The lock according to claim 1, wherein the lock inlet region is funnel shaped.

11. The lock according to claim 1, wherein the at least one spring plate includes an elastic plastic material applied to an inner surface of the at least one spring plate for absorbing shock when the locking bolt is inserted into the lock housing.

12. The lock according to claim 1, wherein the bent sections are pressed against the cross bolt in a direction that is normal to the driving direction.

13. The lock according to claim 1, wherein the at least one spring plate encloses the first end of the locking bow in a region where the locking bolt is connected to the cross bolt.

* * * * *